United States Patent [19]

Kulig

[11] Patent Number: 4,469,271

[45] Date of Patent: Sep. 4, 1984

[54] MULTI-POCKET TRAY

[75] Inventor: Francis V. Kulig, Morris, Ill.

[73] Assignee: Federal Paper Board Co., Inc., Montvale, N.J.

[21] Appl. No.: 428,603

[22] Filed: Sep. 30, 1982

[51] Int. Cl.[3] ..... B65D 5/48

[52] U.S. Cl. ..... 229/28 R; 206/561; 206/562; 206/813; 229/30

[58] Field of Search ..... 229/69, 17 R, 28 R, 229/30, 27; 206/813, 561, 562, 563, 564, 565, 194, 199, 45.19, 45.31; 493/333, 336, 337, 130, 131, 132, 128, 325; 156/252, 256, 257; 118/221, 222; 427/286

[56] References Cited

U.S. PATENT DOCUMENTS

| | | | |
|---|---|---|---|
| 1,167,783 | 1/1916 | Roikjer . | |
| 1,631,080 | 5/1927 | Baker . | |
| 1,892,879 | 1/1933 | Florea et al. . | |
| 2,483,583 | 10/1949 | Holes | 229/28 R |
| 2,554,613 | 5/1951 | Burger | 229/28 R |
| 2,610,784 | 9/1952 | Henry | 229/69 |
| 2,970,738 | 2/1961 | Strange | 229/27 |
| 3,005,584 | 10/1961 | Coe | 229/28 R |
| 3,189,247 | 6/1965 | Wischusen | 229/28 R |
| 3,209,980 | 10/1965 | Festa | 229/28 R |
| 3,229,889 | 1/1966 | Vrana | 229/28 R |
| 3,334,800 | 8/1967 | Hoagland | 229/28 R |
| 3,394,864 | 7/1968 | Coe | 229/28 R |
| 3,565,323 | 2/1971 | Katzenmeyer | 229/28 R |
| 3,722,781 | 3/1973 | Page et al. | 229/30 X |
| 4,089,457 | 5/1978 | Wood et al. | 229/28 R X |

FOREIGN PATENT DOCUMENTS

| | | | |
|---|---|---|---|
| 2242372 | 3/1974 | Fed. Rep. of Germany | 229/27 |
| 2935996 | 4/1981 | Fed. Rep. of Germany | 206/562 |

*Primary Examiner*—William Price
*Assistant Examiner*—Gary E. Elkins
*Attorney, Agent, or Firm*—Charles E. Brown

[57] ABSTRACT

This relates to the formation of a carton or tray wherein a face panel is supported from a base panel by a plurality of struts each having a glue tab which is to be bonded at a local area only of the base panel. It has been found that the necessary glue or adhesive may be applied to the specific areas of the base panel by using a continuous adhesive applicator while at the same time eliminate any alignment of the blank with the adhesive stripe applicator by simply forming the base panel with longitudinally extending longitudinally spaced cut-outs leaving only those areas of the base panel which underlie the glue tabs and wherein when a continuous stripe of adhesive is to be applied, it is applied to only those portions of the base panel which do underlie the glue tabs.

6 Claims, 2 Drawing Figures

MULTI-POCKET TRAY

This invention relates in general to new and useful improvements in multi-pocket trays, and more particularly to a tray which includes a face panel spaced above a base panel by struts. In order to prevent the existence of exposed adhesive or glue 38, each glue tab 32 is of a longitudinal dimension greater than the area coated by the glue.

In accordance with this invention, in lieu of the known multi-pocket trays wherein the face panel is secured to and spaced from the base panel by additional panels, struts are formed from the waste cut-out material which is removed in forming pockets in the face panel and these struts have glue tabs which are bonded to the base panel. Thus the necessary support for the face panel is provided by the struts.

The provision of a plurality of glue tabs which are to be secured to the base panel at spaced intervals poses another problem. This normally required interrupted application of the adhesive or glue which can be accomplished primarily only by an interrupted glue wheel. The use of an interrupted glue wheel poses the additional problem of feeding the blanks to the glue or adhesive wheel in timed relation so as to make certain that the adhesive is applied to only those areas which will underlie the glue tabs of the struts.

The foregoing problem has been solved by the very simple method of removing from the base panel longitudinally aligned and spaced areas on opposite sides of the areas of the base panel where the adhesive is to be applied. Then a continuous glue stripe may be applied but wherein the glue is received only by those areas of the base panel between the removed areas or cut-outs.

With the above and other objects in view that will hereinafter appear, the nature of the invention will be more clearly understood by reference to the following detailed description, the appended claims, and the several views illustrated in the accompanying drawing.

Figure 1:
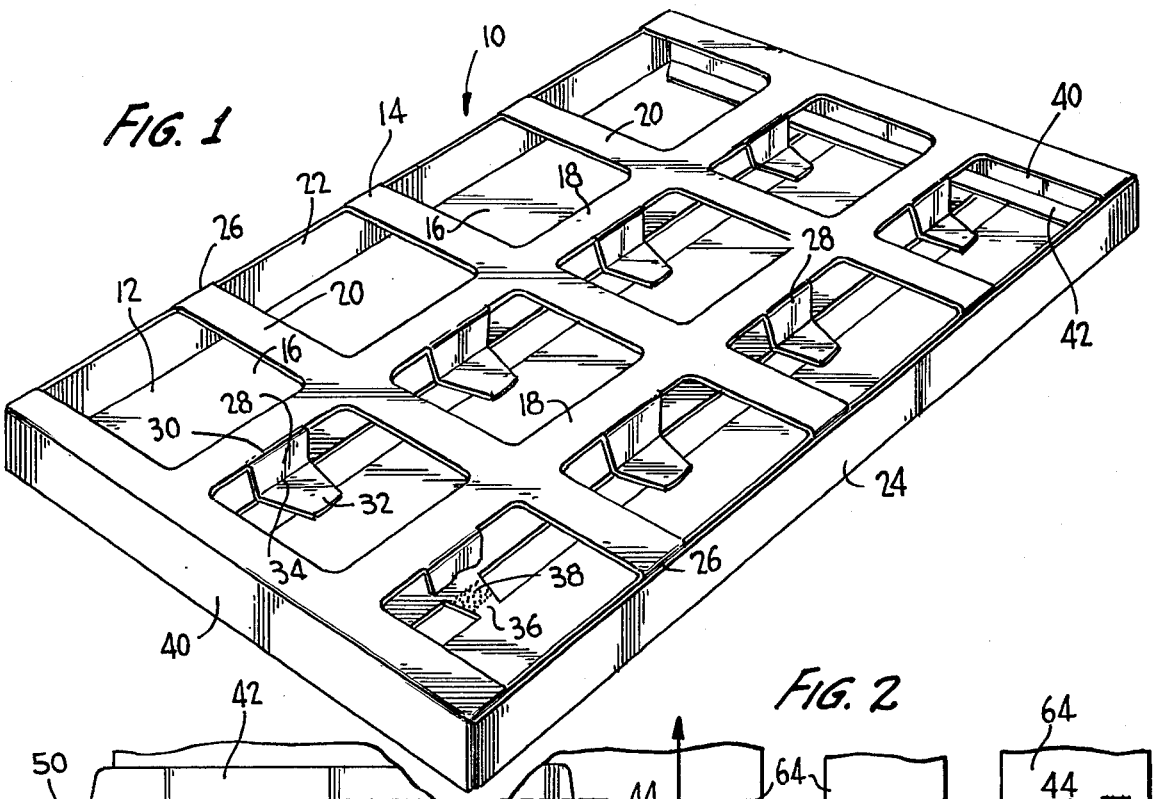
FIG. 1 is a carton or tray formed in accordance with this invention and shows the general construction thereof, one of the glue tabs being omitted so as to illustrate the relationship thereof with respect to an underlying glue or adhesive receiving area of the base panel.

Referring now to the drawings in detail, it will be seen that there is illustrated in FIG. 1 a pocketed carton or tray formed in accordance with this invention, the tray being generally identified by the numeral 10. The tray 10 includes a base panel 12 and an overlying face panel 14. The face panel 14 is provided with a plurality of apertures or cut-outs 16 which are arranged in transverse rows and longitudinal columns. The columns of cut-outs 16 are separated by longitudinally extending straps 18 while the rows of cut-outs or pockets 16 are separated by transverse straps 20.

The ends of the transverse straps 20 are hingedly connected to upper edges of longitudinal upstanding walls 22, 24 along longitudinally extending hinge or fold lines 26.

The face panel 14 is supported from the base panel 12 by a plurality of struts 28 which are hingedly connected to respective straps 18 along longitudinal fold lines 30.

Each strut 28 is, in turn, connected to a glue tab 32 along a lower longitudinal hinge or fold line 34. Each glue tab 32 overlies a glue tab receiving area 36 of the base panel 12 which are applied thereto a longitudinally extending stripe of adhesive or glue 38.

The opposite ends of the carton or tray 10 are closed by upstanding closure panels 40 which, in turn, carry flaps 42 which project into the interior of the carton and lock the carton or tray against folding to its flatly folded original state.

If desired, the upstanding walls 22, 24 may be provided at their opposite ends with end flaps 44 which may be folded inwardly prior to the folding of the closure panels 40 to their closed positions.

The carton or tray 10 is formed from a generally rectangular flat blank 50 formed of a suitable paperboard. It will be seen that in the flat blank state, the base panel 12 is separated from the face panel 14 by the upstanding wall 22 which, in turn, is connected to the base panel 12 along a longitudinally extending hinge or fold line 52. The upstanding wall 24 is disposed along the opposite edge of the blank 50 and is connected to the base panel 12 along a longitudinally extending hinge or fold line 54.

There is also a securing flap 56 which is disposed along the side edge of the blank 50 remote from the upstanding wall 24. The flap 56 is disposed inwardly of the carton or tray and is adhesively secured to the inner surface of the upstanding wall 24. The hinge connection between the straps 20 and the upstanding wall 24 is by way of hinge or fold lines 58 which connect the ends of the straps 20 to the flap 56.

It will be seen that the closure panels 40 are disposed at opposite ends of the face panel and are hingedly connected to the ends of the face panel 14 along transverse hinge or fold lines 60. In a like manner, the flaps 42 are connected to the closure panels 40 along transverse fold or hinge lines 62.

Figure 2:
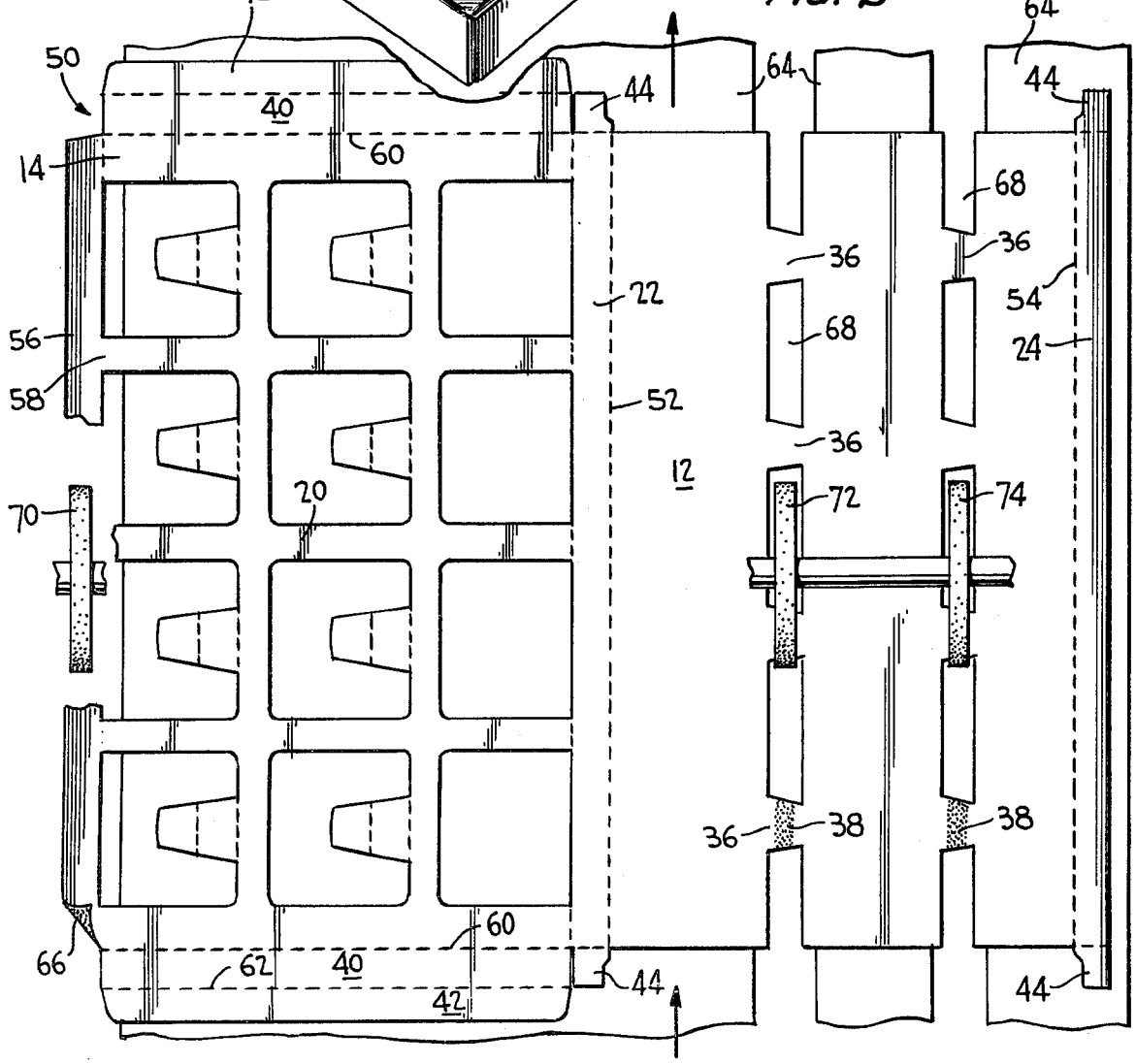
FIG. 2 is a plan view showing the blank of the carton of FIG. 1 with the blank having associated therewith glue or adhesive applying means which will apply adhesive in stripes.

As is best shown in FIG. 2, when adhesive is to be automatically applied to the blank 50, it is moved by suitable conveyor means, such as belts 64, in a longitudinal direction and an adhesive stripe 66 is applied to the underside of the flap 26 while short adhesive stripes 38 are applied to the adhesive receiving areas of the base panel which underlie the glue tabs 32. Further, it will be readily apparent from FIG. 2 that the base panel 12 is provided with a plurality of cut-outs 68 which are in a longitudinally aligned and longitudinally spaced relation so as to define the plurality of longitudinally aligned, longitudinally spaced adhesive receiving areas 36. Thus, not only the adhesive stripe 66 may be continuously applied, but also the interrupted adhesive stripes 38. Any conventional adhesive stripe applying means may be utilized although adhesive applying wheels 70, 72 and 74 are illustrated.

It is to be understood that the formation of the cut-outs 68 in no way unduly weakens the base panel 12 and by this simple step, which has been heretofore unobvious to those skilled in this art, longitudinal adhesive stripes may be applied in a continuous manner yet only the interrupted adhesive stripes 38 will be axially applied and no specific orientation of the adhesive applying apparatus with respect to the carton blank is required.

Although only a preferred utilization of the interrupted adhesive stripe applying method has been illustrated and described herein, it is to be understood that minor variations may be made in the carton construction without departing from the spirit and scope of the invention as defined by the appended claims.

I claim:

1. A multi-pocket carton comprising a base panel, a face panel overlying and spaced above said base panel, said face panel having side edges connected to said base panel by upstanding longitudinal walls, said carton having a plurality of pockets opening through said face panel and defined by cut-outs formed in said face panel and arranged in longitudinal columns separated by longitudinal straps, at least certain of said straps being connected to said base panel by a strut terminating in a glue tab overlying and adhesively secured to said base panel, said base panel having adhesively coated areas underlying said glue tabs with said adhesively coated areas being longitudinally aligned and separated by longitudinally aligned and spaced cut-outs in said base panel.

2. The carton of claim 1 wherein said straps are parallel to said longitudinal walls and each longitudinal wall and each strut is hingedly connected to said base panel along a longitudinal hinge line, said hinge lines all lying generally in a common plane.

3. The carton of claim 2 wherein there are end closures carried by opposite ends of said face panel for closing opposite ends of said carton and locking said carton in an erected state.

4. The carton of claim 3 wherein said carton is a flat tray.

5. The carton of claim 1 wherein said struts and glue tabs are formed of material from said cut-outs.

6. The carton of claim 1 wherein glue tabs are of a longitudinal dimension greater than said coated areas.

* * * * *